United States Patent [19]

Pittman

[11] 4,014,601

[45] Mar. 29, 1977

[54] TUBE SOCKET AND METHOD OF USING SAME

[75] Inventor: Robert B. Pittman, River Edge, N.J.

[73] Assignee: Industrial Electronic Hardware Corporation, New York, N.Y.

[22] Filed: Oct. 28, 1975

[21] Appl. No.: 625,927

[52] U.S. Cl. ..... 339/275 B; 29/626; 339/193 VS; 339/14 T

[51] Int. Cl.[2] ..... H01R 5/04

[58] Field of Search ..... 339/14 T, 17 R, 17 D, 339/143 R, 143 T, 193 R, 193 VS, 275 B; 29/626

[56] References Cited

UNITED STATES PATENTS

| | | | |
|---|---|---|---|
| 2,211,659 | 8/1940 | Johanson | 339/275 B X |
| 2,951,226 | 8/1960 | Gittens | 339/17 D |
| 2,977,565 | 3/1961 | Uhlig | 339/193 VS X |
| 3,222,632 | 12/1965 | Fuller | 339/17 R X |
| 3,502,933 | 3/1970 | Leimontas et al. | 339/143 T |
| 3,603,914 | 9/1971 | Manetti et al. | 339/143 T |
| 3,733,522 | 5/1973 | Simovits et al. | 339/143 T X |

*Primary Examiner*—Gerald A. Dost

[57] ABSTRACT

A socket for mounting a cathode ray tube having a plurality of conductive contact elements disposed about the neck thereof comprises a housing defining a central aperture extending therethrough for receipt of the tube neck, spaced conductive contacts mounted on the housing with first end portions adjacent to the central aperture for engagement with the conductive contact elements disposed about the tube neck, and a removable plug extending across and substantially completely obstructing the central aperture intermediate the first contact end portions and the plane of the housing front surface. The removable plug blocks the passage of solder from the front of the central aperture to the first contact end portions during soldering of the second contact end portions to a printed circuit board (thus preventing short circuiting of the first contact end portions), but is easily removable from the housing to enable passage of a tube neck through the central aperture. The novel design of the socket permits the removable plug to be included, at no extra cost, as part of a member having a first portion disposed within the housing and a second portion comprising the plug which is readily severably connected to the first portion.

23 Claims, 6 Drawing Figures

TUBE SOCKET AND METHOD OF USING SAME

BACKGROUND OF THE INVENTION

The present invention relates generally to a socket for mounting a tube having a plurality of conductive contact elements disposed about the neck thereof, and the method of using the same, and more particularly to sockets for mounting such tubes on printed circuit boards and affording spark gap protection to critical circuits.

Cathode ray tubes are presently in wide use in the electronics industry. Although they perform a variety of functions, these tubes are probably most well known as picture tubes in television receivers. Conventional cathode ray tubes generally have a plurality of pins or leads extending in a ring-like configuration from the base of the tube to enable the tube pins to be plugged into the enveloping pin terminal contacts of the socket and thus become connected to the remainder of the electrical components. The normal operating potential of all the pins, except one, is in the range of a few thousand volts. However, the remaining pin, often referred to as the high voltage pin, operates at a substantially high voltage, usually in the neighborhood of 25,000 volts DC or greater.

In order to prevent damage to the cathode ray tube caused by excessive voltage at the pins, cathode ray tube sockets are normally provided with some sort of safety device in the form of grounding apparatus. Usually the grounding apparatus permits a spark to jump from the pin contact to ground in the event that the pin is operating at an excessive potential. This prevents damage to the tube due to excessive potential at one of the pins by providing a non-destructive path to eliminate the excess.

In the past, the grounding apparatus has commonly taken the form of a single grounding plate which is spaced from the pin terminals in the socket by means of an insulating plate. The insulating plate or spacer is provided with holes aligned with the pin terminals to permit the spark to jump from the terminal to the grounding plate. The distance between the grounding plate and the terminal will determine the potential necessary to permit a spark to bridge the gap between the terminal and the grounding plate. Sockets offering spark gap protection of the type described are the subject matter of Pittman U.S. Pat. No. 3,423,720 (issued Jan. 21, 1969) and Offerman U.S. Pat. No. 3,728,587 (issued Apr. 17, 1973), both assigned to the assignee of the present application.

Because of the normal operating range of the high voltage pin, the space between the high voltage pin terminal and the grounding plate is usually greater than the space between the remaining pin terminals and the grounding plate so that a higher potential is necessary before a spark can bridge the gap between the high voltage pin terminal and the grounding plate. However, this grounding configuration has a very great disadvantage. Specifically, if a spark jumps from the high voltage pin terminal to the ground plate, the potential of the ground plate may rise faster than it can be dissipated to the ground. A second spark may then jump from the ground plate back to one of the other pin terminals, thus seriously damaging the tube. To overcome this disadvantage, cathode ray tube sockets have been provided with a second grounding plate for grounding the high voltage pin, the second grounding plate being physically and electrically independent of the low voltage grounding plate. The high voltage grounding plate has a separate grounding wire extending therefrom to an appropriate grounding member, such as the chassis of the electrical component, and is physically and electrically separated from the low voltage grounding plate. In this way, a spark which has jumped from the high voltage terminal to the high voltage grounding plate cannot jump back to any of the remaining contacts to damage the tube. Sockets describing such a dual spark gap protection grounding system are described in Pittman U.S. Pat. No. 3,865,452 (issued Feb. 11, 1975), also assigned to the assignee of the present invention.

In all of the above-described systems, the sockets utilize discrete wire leads connected to the individual pin contacts of the sockets which engage the contact elements extending from the base of the cathode ray tube. More recently, such sockets have been adapted to eliminate, for the most part, the discrete wire lead system by mounting the socket directly to a printed circuit board. Because of the limited potential handling capability of the printed circuit board, the high voltage lead and, in some cases, the ground lead are maintained as discrete wire leads. The contact members of the sockets (replacing the discrete wire leads) are passed through small corresponding apertures of the printed circuit board and then soldered to the exposed side of the printed circuit board. Typically the soldering operation utilized to secure the socket to its printed circuit board mounting is either a dip solder or wave solder operation. In the dip solder operation, the portions to be soldered (the exposed printed circuit board surface and the contact ends projecting downwardly therefrom) are actually immersed in a molten solder bath. In the wave solder operation, the surfaces to be soldered are spaced slightly above a molten solder bath, and a wave is created in the molten solder bath which is of sufficient height to effectively wet the portions to be soldered. As the enveloping pin terminal contacts of the socket are disposed on the surface of the socket opposite the surface being exposed to the solder and are typically spaced from any central aperture of the socket housing, judicious selection of the immersion depth in the dip solder operation or of the wave height in the wave solder operation suffices to insure that solder does not enter the enveloping pin terminal contacts and accidentally form a short circuit between adjacent contacts.

In response to the recent introduction of a new type of cathode ray tube (commonly called a "small neck CRT"), it has been desirable to modify the above-described sockets. In the small neck CRT, the contact elements do not extend from the base of the tube, but rather are disposed along the periphery of the neck of the tube, adjacent to the base. This requires the use in the socket of what is commonly referred to as a "single sided contact" rather than the enveloping type of pin terminal contact heretofore used in such sockets. The single sided contacts are disposed about the periphery of (and typically at least partially within) a large central aperture of the socket, the small neck CRT being mounted on the socket with the neck portion thereof adjacent the base being disposed within the large central aperture of the socket. The modified socket is designed to be mounted directly on a printed circuit board, with discrete wires being used only for the high voltage and ground connections, the remainder of the contacts being soldered to the exposed surface of the printed circuit board as in the past. However, the printed circuit board is provided with a large central aperture therethrough aligned with the large central aperture of the socket, so that the tube neck may be inserted into the socket through the printed circuit board. As a result of this design, problems have been encountered during the soldering operation as the solder is sucked up through the large center aperture of the printed circuit board and into the large center aperture of the socket due to a chimney effect of the aligned large central apertures. This is obviously undesirable as the solder entering into the large central aperture of the socket is capable of forming short circuits between the spaced single sided contacts of the socket extending into the large central aperture, thus requiring rejection of the socket.

In order to overcome this disadvantage of the modified socket design, a removable cardboard plug is conventionally inserted into the large central aperture of the socket intermediate the single sided contacts and the surface of the socket adjacent the printed circuit board. The cardboard disc is pressed into the large central aperture of the socket just enough to guarantee its integrity and retention by the socket. After the soldering operation has been completed, the cardboard disc is then pushed out of the large central aperture of the socket and through the large central aperture of the printed circuit board, thus exposing both of the large central apertures for receipt of the tube neck. While the use of the cardboard disc has provided a solution to the problem raised by the modified socket design, the need to provide the cardboard disc and to insert it into the socket has added to the manufacturing cost of such removably plugged sockets. Furthermore, during the process of inserting the cardboard disc into the socket, it is possible for the cardboard disc to become slightly bent out of shape, thereby creating a gap (between the cardboard disc and the adjacent socket wall defining the large central aperture) through which the solder can pass.

Accordingly, it is an object of the present invention to provide a socket for mounting a tube having conductive contact elements disposed along the neck thereof to a printed circuit board which includes a removable solder plug for protecting the single sided contacts of the socket at essentially no additional material or processing costs.

Another object is to provide such a socket which precludes the possibility of gaps between the removable solder plug and the socket wall defining the large central aperture.

Still another object is to provide a socket in which the removable solder plug is formed of the same material as the insulating plate or spacer and is created during and as part of the creation of the insulating plate from material heretofore discarded after creation of the insulating plate.

A further object is to provide a method of mounting such a socket on a printed circuit board without the step of first inserting a removable solder plug into the central aperture of the socket.

SUMMARY OF THE INVENTION

It has now been found that the above and related objects of the present invention are obtained in a socket for mounting a tube having a plurality of conductive contact elements disposed about the neck thereof comprising a housing defining a front surface, a back surface and an aperture (preferably a central aperture) extending therethrough for receipt of the tube neck. Spaced conductive contacts are mounted on the housing with first end portions spaced from the housing front surface and adjacent to the aperture for engagement with the conductive contact elements disposed about the tube neck, and second end portions projecting from the housing. The socket further includes a member having a first portion (comprising an insulating plate or spacer) disposed within the housing and a second portion (comprising a solder-blocking plug) extending across and substantially completely obstructing the aperture intermediate the first contact end portions and the plane of the housing front surface. At least a portion of the peripheral edge of the second member portion may be removably disposed within the housing. The first and second member portions are readily separably connected to one another so that the second member portion blocks the passage of solder from the front of the aperture to the first contact end portions, but is easily removable from the housing to enable passage of the tube neck through the aperture.

The first member portion is of generally annular configuration while the second member portion is of generally circular configuration, the outer diameter of the second member portion being essentially indentical to the inner diameter of the first member portion. The member is typically stamped out of a sheet of insulating material, the second portion preferably being formed during and as part of the same operation in which the first member portion is formed and comprising the heretofore discarded stamped-out center portion. Thus, the second member portion is formed at no additional material or process cost.

The member is preferably formed of an insulating material, such as mica, and is generally substantially planar and of substantially uniform thickness, preferably a thickness of less than 0.50 millimeter. The first and second member portions are pressure fit together in edge-to-edge relationship. As the first contact end portions (the single sided contacts) extend into the housing aperture intermediate the second member portion and the housing back surface, the presence of the second member portion intermediate the housing front surface and the first contact end portions precludes the passage of solder from the housing front surface to the first contact end portions through the housing aperture.

In a preferred embodiment, the housing comprises an apertured base defining a housing back surface and an apertured cover defining the housing front surface and being secured to the housing base. The first member portion is disposed intermediate portions of the opposing surfaces of the housing base and the housing cover. The socket may additionally include a ground plate of conductive material, in which case the first member portion spaces the plate from intermediate portions of the contacts and defines at least one small aperture extending therethrough aligned with a segment of the plate and the intermediate portion of at least one of the contacts. The small aperture in the first member portion thus provides spark gap protection for the aligned contact.

In combination with the socket may be a printed circuit board defining a printed front surface, a back surface, at least one prime aperture therethrough, and a plurality of smaller apertures therethrough. The board is mounted on the housing with the housing front surface facing the board back surface, at least one board prime aperture and the housing aperture being in alignment, and the second contact end portions extending through the smaller board apertures and projecting forwardly from the board front surface. The combination typically additionally includes solder means disposed on and securing the second contact end portions to the board front surface.

The present invention also encompasses a process for applying solder to the spaced contacts of a socket without conductively joining the contacts thereof. The process comprises applying molten solder on and about the second contact end portions with the second member portion in place and thereafter removing the second member portion from the socket. Typically, the second contact end portions are initially inserted through a printed circuit board defining at least one prime aperture therethrough to mount the socket on the board with the aperture of the socket housing and the prime aperture of the printed circuit board in alignment. The molten solder is typically applied to the second contact end portions extending forwardly from the board and to the adjacent board surface by immersing the second contact end portions, the adjacent board surface and the front of the board aperture in molten solder, for example, by either a dip or wave solder operation.

DETAILED DESCRIPTION OF THE PREFERRED EMBODIMENTS

Figure 3:
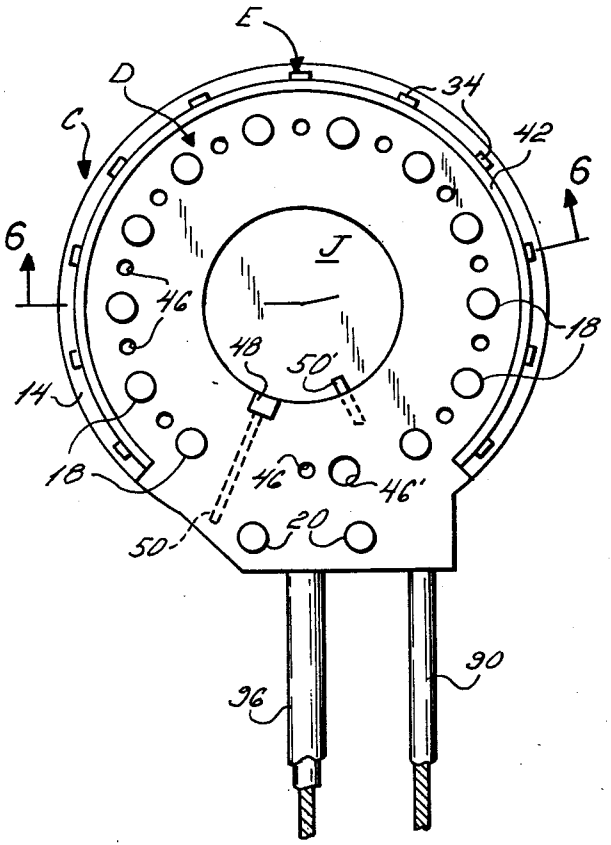
FIG. 3 is a front plan view thereof.
Figure 2:
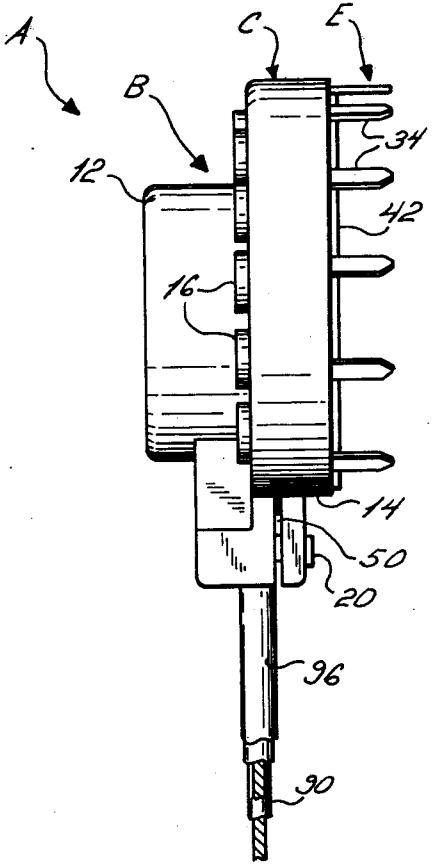
FIG. 2 is a side elevation view thereof.
Figure 1:
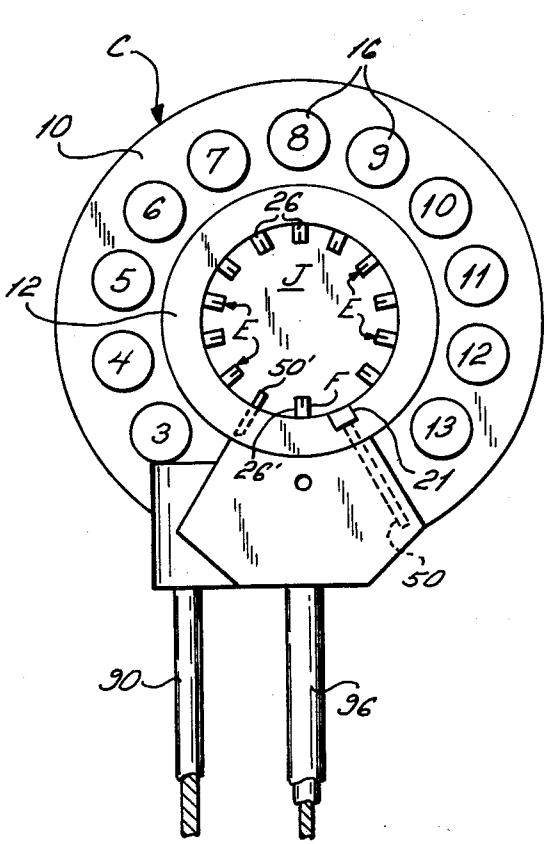
FIG. 1 is a rear plan view of a socket according to the present invention.
Figure 4:
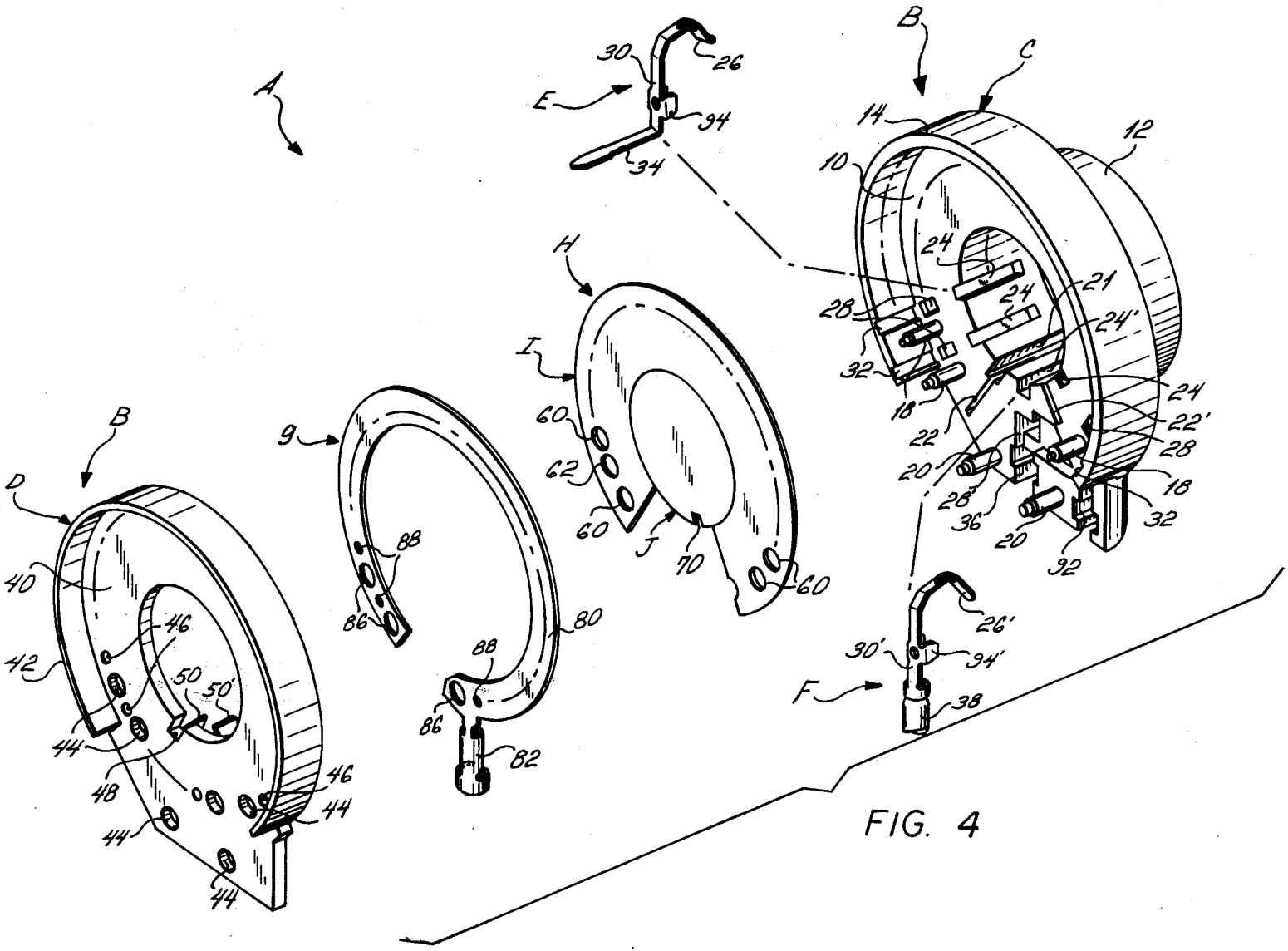
FIG. 4 is an exploded perspective view of the elements thereof.

Referring now to the drawing, and in particular to FIGS. 1–4 thereof, the cathode ray tube socket A of the present invention generally comprises an insulating housing B formed of a base or rear plate C and a cover or front plate D, the housing defining a large central aperture extending therethrough. Mounted on the housing B are a plurality of low voltage contacts E and a single high voltage lead F. Mounted within the housing B are a conductive ground plate G disposed adjacent the cover D and a member H disposed adjacent the base C. The member H is in turn composed of a generally annular first portion I disposed within the housing B and a readily severable second portion J extending across and substantially completely obstructing the large central aperture of the housing B. The socket A is adapted to be mounted on a printed circuit board K (see FIG. 6) by means of contacts E and solder.

More particularly, each of the housing elements C and D which assemble to form the insulating housing B is composed of a molded insulating material and is of generally disc shape. The centrally apertured base or rear plate C comprises a generally planar body 10 having a rearwardly extending inner rim 12 and a forwardly extending outer rim 14 spaced therefrom. As the socket A is designed for use with eleven low voltage contacts E, the rear surface of the body 10 is provided with eleven raised disc-like portions 16 (see FIG. 1) numbered from 3 to 13, each portion being aligned with an intermediate portion of a respective one of the contacts E. The numerals 1 and 2 are implicitly reserved for the high voltage lead F and the lead of the ground plate G, respectively. The forward surface of body 10 includes 12 forwardly extending stubs 18, one stub being disposed on either side of each contact E, and a pair of similar stubs 20 disposed about the high voltage lead F. The inner rim 12 and body 10 of the base C is provided with a keyhole slot 21 designed to receive a lug on the neck of the tube inserted therethrough and insure proper angular orientation of the tube relative to the socket A. On either side of the area to be occupied by the high voltage lead F are slots 22, 22′, each being angularly disposed intermediate a stub 18 and a stub 20 for purposes to be described in detail hereinafter. Preferably slot 22 is aligned with keyhole slot 21.

Spaced along the inner surface of rear rim 12 are outwardly extending recesses 24, 24′ communicating with the front surface of body 10 and designed to receive the single contact end portions 26, 26′ of the contacts E and the high voltage lead F, respectively. Intermediate each of the stubs 18 is a rearwardly extending recess 28, 28′ in the front surface of body 10 designed to receive the intermediate portions 30, 30′ of contacts E and high voltage lead F, respectively. Spaced along the inner surface of front rim 14 are outwardly extending recesses 32 designed to receive the forwardly extending end portions 34 of the contacts E. A recess 36 in the front surface of body 10 intermediate stubs 20 is designed to receive the wire gripping portion 38 of high voltage lead F. Obviously recesses 24, 28 and 32 are aligned, as are recesses 24′, 28′ and 36.

The centrally apertured front plate or cover D comprises a generally planar body 40 having a forwardly extending outer rim 42 adapted to fit circumferentially within rim 14 of the base C when the cover D is mounted on the base C. The body 40 additionally defines a plurality of apertures 44 for receipt therethrough of stubs 18, 20 of the base C and a plurality of smaller apertures 46, each aperture 46 being aligned with one of the rearwardly extending recesses 28, 28′ of the base C to permit the escape of ozone formed during the spark gap action. An additional aperture 46′ adjacent the high voltage lead F is optionally provided to further facilitate the escape of ozone formed by sparking of lead F. The inner surface of the body 40 includes a keyhole slot 48 aligned with the keyhole slot 21 of the base C, and serving a similar purpose. The rear surface of the body 40 additionally includes rearwardly extending flange portions 50, 50′ adapted to be received within slots 22, 22′, respectively, of cover body 10 for the purpose of electrically isolating the high voltage lead F from a contact E on one side thereof and a portion of the conductive ground plate G on the other side thereof. The flange 50′ appreciably extends inwardly of the body 40 and enters the central aperture for the purpose of cooperating with the keyhole portions 21, 48 in defining the correct angular orientation of the tube neck relative to the socket A by entering a groove in the tube neck. Preferably flange 50 is aligned with keyhole slot 48.

The member H is substantially planar and of generally circular configuration. The first or outer portion I thereof is generally annular in design and is disposed within the housing B (intermediate base C and cover D) with the outer surface thereof fitting within the inner surface of the outer rim 14 of the base C. The outer or first portion I defines a plurality of apertures 60 aligned with the stubs 18 of base C to permit their passage therethrough and one or more additional apertures 62 therethrough aligned with the intermediate portions 30 of those contacts E to be provided with spark gap protection. The annular configuration of the outer portion I is interrupted to provide a gap to permit passage thereby of the lugs 50, 50' of cover D, and no segment of the outer portion I extends into the central aperture defined by housing B. In these respects, the outer portion I is identical to the conventional insulating plate or spacer.

The inner or second portion J of member H is of generally circular configuration with a recess 70 being provided therein to enable snug passage thereby of the portion of lug 50' of the cover D extending into the central aperture. The second or inner portion J extends across the central aperture of the housing B and substantially completely obstructs the same to preclude solder, flux or other fluids from entering through the central aperture of the cover D into the central aperture of the base C where it could short circuit the contact ends 26, 26'. In other words, the second or inner portion J acts as a solder plug to preclude passage of fluid through the central aperture of the housing B from the front surface D to the rear surface C, thus protecting the contact ends 26, 26' disposed in base C from the fluid. In certain instances, it may be preferred that the plug J extend outwardly slightly beyond the central aperture of housing C, typically by no more than the depth of recesses 24, so that at least a portion of the preferred edge of plug J is removably disposed within the housing B.

The member H is preferably formed of an insulating material, such as mica, which enables the plug J to be pressure fit into the outer member portion I in edge-to-edge relationship for handling as a single unit while remaining readily severable therefrom. Preferably the insulating material is relatively rigid to facilitate cutting or stamping thereof and enable the formation of a desirable edge joint. Where the periphery of the plug J extends outwardly beyond the central aperture of housing B so that a peripheral portion of plug J is disposed within the housing B (i.e., intermediate base C and cover D), the insulating material must be capable of flexing sufficiently to permit removal of the plug J from the housing B. It is preferred that the member H be substantially planar and of uniform thickness, typically a thickness of less than 0.50 millimeter.

The inner portion J replaces the conventional cardboard solder plug, thus avoiding the material and processing (insertion) costs associated with the conventional cardboard solder plug. The inner portion J is essentially a heretofore discarded by-product of the formation of the outer portion I, a circular inner portion J for each annular outer portion I being necessarily stamped out of the sheet of insulating material during the stamping out of each outer portion I. The method of forming inner portion J and fitting it within outer portion I for handling as a unit is described hereinbelow in further detail.

The ground plate G comprises a generally annular portion 80 defining a cutout adjacent the high voltage lead F and a wire clamping portion 82 outwardly disposed on one of the ends thereof. The annular portion 80 is generally planar with an outer surface appreciably spaced from the outer rim 14 (and hence from contact end portions 34) and an inner surface appreciably spaced from the cental aperture of housing B (and hence from contact end portions 26), the outer and inner diameter of the annular portion 80 being, respectively, less than and greater than those of the annular portion I of member H. The annular portion 80 is furthermore provided with a plurality of large apertures 86 and smaller apertures 88 aligned with the large apertures 44 and smaller apertures 46, respectively, of the cover D and serving the same function thereas. The wire clamping portion 82 is adapted to grasp one end of a ground wire 90 (see FIGS. 1–3) and fit within recess 92 of the base C.

Each of the eleven low voltage conductive contacts E comprise a rearwardly extending arcuate single sided contact end portion 26, a forwardly extending end portion 34, and an outwardly extending intermediate portion 30 including a spaced pair of rearwardly extending resiliently biased lugs 94. The single sided contact end portion 26 is partially seated within recess 24 of the base inner rim 12, with a portion thereof extending into the central aperture, the intermediate portion 30 rests on the rear surface of the base body 10 with the lugs 92 being resiliently seated within body recess 28 for securing the contact E to the base C, and the forwardly extending end portion 34 is partially seated within the recess 32 of the outer rim 14, with the tip thereof extending forwardly therefrom and the inner surface thereof being substantially flush with the inner surface of the outer rim 14.

The high voltage lead F comprises a rearwardly extending single sided contact end portion 26', an outwardly extending wire clamping end portion 38 adapted to be secured to a high voltage wire 96 (see FIGS. 1–3) and an outwardly extending intermediate portion 30' including a spaced pair of rearwardly extending resiliently biased lugs 94'. The single sided contact end portion 26' is seated at least partially within the recess 24' of the base inner rim 12 with a portion thereof extending into the central aperture, the intermediate portion 30' rests on the rear surface of the base body 10 with the lugs 94' being resiliently seated within body recess 28' for securing the high voltage lead F to the base C, and the wire clamping end portion 38 is seated within the recess 36 of the base C.

The components of the socket A are easily assembled in the following steps. The low voltage contacts E are affixed to the base C with the fastening lugs 94 thereof snugly fitted within the recesses 28, the single sided contact end portions 26 thereof at least partially disposed within the recesses 24, and the forwardly projecting end portions thereof at least partially disposed within the recesses 32. The member H is then mounted on the base C with the stubs 18 passing through the apertures 60 of the annular portion I, the apertures 62 aligned with the lugs 94 of the contacts E to be provided with spark gap protection, and the slot 70 of plug J radially aligned with cover slot 22'. The ground plate G is then mounted on the base C over the member H with the stubs 18 passing through the large apertures 86, the small apertures 88 aligned with the recesses 28, and the wire clamping portion 82 (already fastened to ground wire 90) fitted within recess 92. The high voltage lead F is then mounted directly on base C with the fastening lugs 94' fitted within recess 28', the single sided contact end portion 26' at least partially disposed within the recess 24', and the wire clamping end portion 38 (already fastened to high voltage wire 96) fitted within recess 36. Finally, the cover D is mounted on the base C with the stubs 18 and 20 of the base C snugly passing through the large apertures 44, the small apertures 46 aligned with recesses 28, and the rim 42 snugly fitted radially inwardly of the outer base rim 14. Contact intermediate portions 30 and high voltage lead portions 30' and 38 are trapped between base body 10 and cover body 40, while contact end portions 34 are at least partially trapped between base rim 14 and cover rim 42.

Figure 6:
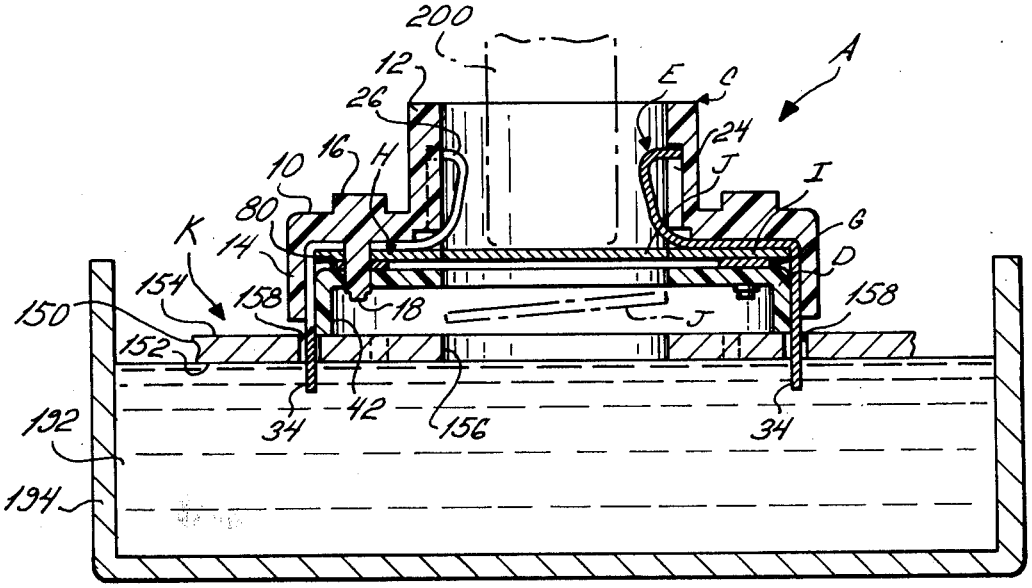
FIG. 6 is a fragmentary side elevation view, partially in cross-section, illustrating a method of mounting such a socket (taken along the line 6—6 of FIG. 3) to a printed circuit board, securing it thereto with solder, and, in phantom line, removing the removable plug therefrom.

Referring now to FIG. 6, the socket A as described above is then mounted on a printed circuit board K. The printed circuit board K comprises a substantially planar member 150 having a printed front surface 152, a rear surface 154, at least one large central aperture 156, and a plurality of smaller apertures 158 disposed about each of the prime apertures 156. The printed front surface 152 defines a plurality of conductive paths to which solder will adhere and an insulative background to which solder will not adhere. The front surface of the socket A, and more particularly the forward surface of cover rim 42 is mounted on the rear surface 154 of the printed circuit board K with the forwardly extending end portions 34 of the contacts E passing through the small apertures 158 thereof and projecting forwardly from the front surface 152 thereof and the large central aperture of socket A being aligned with one of the prime apertures 156 of the printed circuit board K.

Molten solder 192 from a tank 194 is then applied to the assembly in conventional manner (for example, by a dip or wave solder operation) so as to expose to the solder 192 the board front surface 152, the end portions 34 of contacts E extending therefrom, and the board prime aperture 156. The presence of the plug portion J of the member H in the large central aperture of housing B protects the single sided contact end portions 26 of contacts E disposed within the large cental aperture of the housing B and spaced from the front surface of the housing B from contact with any of the solder 192 which may be drawn upwardly by a chimney effect through the board prime aperture 156 and the aligned central aperture of cover D. After completion of the soldering operation, the assembly comprised of socket A and the printed circuit board K is removed from the solder bath 194. Upon separation of the assembly from the molten solder 192, quantities of the solder will remain on and about the segments of contact end portions 34 extending from the board front surface 152 and the adjacent conductive paths of the board front surface 152, the solder upon cooling securing the socket A to the printed circuit board K.

Finally a rod 200 (illustrated in phantom line) is pushed through the central aperture of housing B from the rear surface thereof to remove plug portion J from the annular portion I of member H (see the plug portion J illustrated in phantom line) and push it through the aligned large central aperture of the grounding plate G, the housing cover D, and the printed circuit board K. With the plug portion J removed, the assembly composed of socket A and the printed circuit board K is now ready to receive a cathode ray tube (or for that matter any other tube of similar neck configuration), the tube being insertible through the board prime aperture 156 into the socket large central aperture, with a protruding portion of the tube neck fitting within the keyhole slots 48, 21 of the socket A and a portion of flange 50' fitting within a longitudinal slot of the tube neck to insure that the appropriate conductive contact elements disposed about the tube neck engage the appropriate single sided contact end portions 26, 26' of the contacts E and high voltage lead F, respectively.

Figure 5:
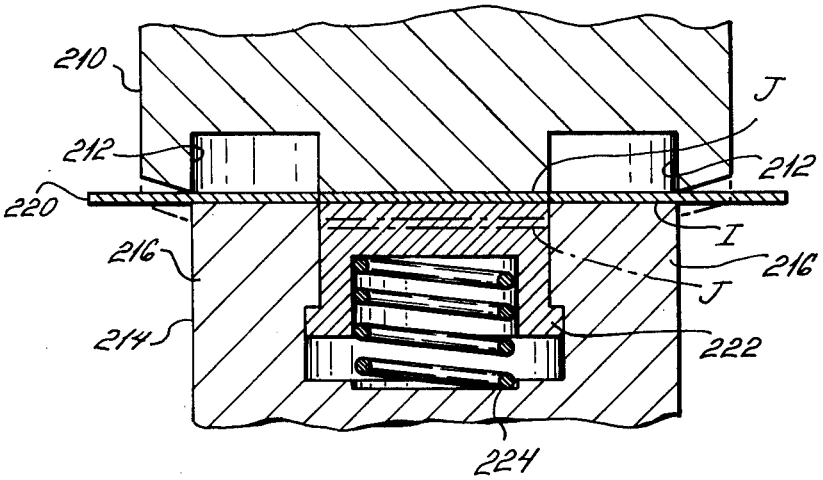
FIG. 5 is a fragmentary schematic side elevation view, partially in cross-section, of apparatus useful in forming one of the elements of the present invention.

Referring now to FIG. 5, the member H is easily formed by a slight modification of the die assembly conventionally used to stamp out the annular portion I. As in the prior practice, upper die face 210 defines an annular recess 212 while opposed lower die face 214 defines a matching annular projection 216. A sheet of insulating material 220 is interposed between die faces 210 and 214, ad the die faces 210, 214 closed, thereby stamping out the annular portion I and the circular portion J (see the position and parts indicated in phantom line). In the prior art practice, the annular portion I was utilized in the socket A while the circular portion J was discarded. For the purposes of the present invention, the lower die face 214 is modified to include a plunger 222 fit within the central recess defined by the annular projection 216 thereof and biased upwardly by resilient means such as a spring 224. The closing of the die faces 210 and 214 downwardly displaces plunger 222 immediately below severed circular portion J and compresses the spring 224. Thereafter, upon partial separation of the die faces 210, 214, spring 224 urges plunger 222 upwardly, the plunger 222 carrying on its upper surface the circular portion J (illustrated in phantom line). The plunger forcefully returns circular portion J to the plane of annular portion I where the two engage in an edge-to-edge pressure-fit relation for subsequent handling as a unit. The plunger 222 and the recess of die face 214 are configured and dimensioned to provide a stop limit action which precludes plunger 222 from urging the circular portion J upwardly past the annular portion I, upon complete separation of die faces 210, 214.

As the circular portion J would otherwise have been discarded, no additional material costs are involved in the modified process, and, except for the one time expenditure for modification of the die design to provide plunger 222 and spring 224, no additional processing costs are involved. As the center portion of the die face 210 provides a planar surface against which the circular portion J is returned by the plunger 222 when the die faces 210, 214 are partially separated, circular portion J retains its generally planar configuration during pressure fitting to annular portion I, thus precluding the formation of a gap between the member portions I and J.

To summarize, a novel socket is provided according to the present invention which includes an easily removable solder-blocking plug to protect the single sided contact end portions during the soldering operation at no additional cost, a heretofore discarded portion of the insulating material used to form the insulating plate being used for this purpose.

Now that the preferred embodiments of the present invention have been shown and described in detail, various modifications, improvements and additional uses therefor will become readily apparent to those skilled in the art. For example, the principles of the present invention are equally applicable to sockets utilizing a second ground plate to provide spark gap protection for the high voltage lead. Accordingly, the spirit and scope of the present invention is to be limited only by the appended claims, and not by the foregoing disclosure.

I claim:

1. A socket for mounting a tube having a plurality of conductive contact elements disposed about the neck thereof comprising:

A. a housing defining a front surface, a back surface and an aperture extending therethrough for receipt of a tube neck;

B. spaced conductive contacts mounted on said housing having first end portions spaced from said housing front surface and adjacent said aperture for engagement with conductive contact elements disposed about the tube neck, and second end portions projecting from said housing; and C. a member of uniform given composition having a first portion disposed within said housing and a second portion extending across and substantially completely obstructing said aperture intermediate said first contact end portions and the plane of said housing front surface; said first and second member portions being readily separably connected to one another;

whereby said second member portion blocks the passage of solder from the front of said aperture to said first contact end portions, but is easily removable from said housing to enable passage of a tube neck through said aperture.

2. The socket of claim 1 wherein at least a portion of said second member portion is disposed within said housing.

3. The socket of claim 1 wherein said first contact end portions extend into said housing aperture intermediate said second member portion and said housing back surface.

4. The socket of claim 1 wherein said member is substantially planar.

5. The socket of claim 1 wherein said member is formed of insulating material.

6. The socket of claim 5 wherein said member is formed of mica.

7. The socket of claim 4 wherein said member is formed of insulating material.

8. The socket of claim 1 wherein said member is substantially uniform thickness.

9. The socket of claim 8 wherein said member has a thickness of less than 0.50 millimeter.

10. The socket of claim 1 wherein said first and second member portions are pressure-fit together in edge-to-edge relationship.

11. The socket of claim 9 wherein said first and second member portions are pressure-fit together in edge-to-edge relationship.

12. The socket of claim 1 wherein said housing comprises an apertured base defining said housing back surface and an apertured cover defining said housing front surface and being secured to said housing base, said first member portion being disposed intermediate portions of the opposing surfaces of said housing base and said housing cover.

13. The socket of claim 12 wherein at least a portion of the peripheral edge of said second member portion is removably disposed intermediate portions of the opposing surfaces of said housing base and said housing cover.

14. In combination with the socket of claim 1, a printed circuit board defining a printed front surface, a back surface, at least one prime aperture therethrough, and a plurality of smaller apertures therethrough, said board being mounted on said housing with said housing front surface facing said board back surface, said at least one board prime aperture and said housing aperture in alignment, and said second contact end portions extending through said board smaller apertures and projecting forwardly from said board front surface.

15. The combination of claim 14 additionally including solder means disposed on and securing said second contact end portions to said board front surface.

16. A process for applying solder to the spaced contacts of a socket without conductively joining the contacts comprising the steps of A. providing a socket having a housing defining an aperture therethrough, spaced contact members mounted on the housing with first end portions disposed in the aperture and second end portions extending forwardly from the housing, and a member of uniform given composition having a first portion disposed within the housing and a second portion extending across and substantially completely obstructing the aperture intermediate the first contact end portions and the front of the aperture, the first and second member portions being readily separable from one another;

B. applying molten solder on and about the second contact end portions with the second member portion in place;

C. thereafter removing the second member portion from the socket.

17. The process of claim 16 wherein prior to step (A) the member is formed by pressure fitting the second member portion within the first member portion in edge-to-edge engagement for mounting of the member in the housing as an integral unit.

18. The process of claim 17 wherein the member is formed of insulating material.

19. The process of claim 16 wherein prior to step (A) the first and second member portions are formed in a single stamping operation in which the second member portion is severed and displaced from the first member portion, and then the member is formed by pressure fitting the second member portion within the first member portion in edge-to-edge engagement for mounting of the member in the housing as an integral unit.

20. The process of claim 19 wherein the member is formed of insulating materia.

21. The process of claim 16 wherein the member is formed of insulating material.

22. In combination with the socket of claim 1, a tube having a neck and a plurality of conductive contract elements disposed about said neck, said neck being adapted to be received in said aperture with said conductive contact elements engaging said socket contacts after removal of said second member portion.

23. A socket for mounting a tube having a plurality of conductive contact elements disposed about the neck thereof comprising:

A. a housing defining a front surface, a back surface and an aperture extending therethrough for receipt of a tube neck;

B. spaced conductive contacts mounted on said housing having first end portions spaced from said housing front surface and adjacent said aperture for engagement with conductive contact elements disposed about the tube neck, and second end portions projecting from said housing;

C. a member having a first portion disposed within said housing and a second portion extending across and substantially completely obstructing said aperture intermediate said first contact end portions and the plane of said housing front surface; said first and second member portions being readily separably connected to one another whereby said second member portion blocks the passage of solder from the front of said aperture to said first contact end portions, but is easily removable from said housing to enable passage of a tube neck through said aperture; and D. a ground plate of conductive material, said first member portion spacing said plate from intermediate portions of said contacts and defining at least one small aperture extending therethrough aligned with a segment of said plate and the intermediate portion of at least one of said contacts, thereby to provide spark gap protection.

* * * * *